US005944315A

United States Patent [19]

Mostashari

[11] Patent Number: 5,944,315

[45] Date of Patent: Aug. 31, 1999

[54] POKER GAME WITH DESIGNATABLE JOKERS

[76] Inventor: Moe Mostashari, 2825 E. Diana Ave., Anaheim, Calif. 92806

[21] Appl. No.: 09/032,805

[22] Filed: Mar. 2, 1998

[51] Int. Cl.[6] ..... A63F 1/00

[52] U.S. Cl. ..... 273/292

[58] Field of Search ..... 273/292, 303

[56] References Cited

U.S. PATENT DOCUMENTS

| | | | |
|---|---|---|---|
| 5,288,081 | 2/1994 | Breeding | 273/292 |
| 5,397,128 | 3/1995 | Hesse | 273/292 |
| 5,713,574 | 2/1998 | Hughes | 273/292 |
| 5,799,945 | 9/1998 | Boylan | 273/292 |

*Primary Examiner*—Robert A. Hafer
*Assistant Examiner*—Kurt Fernstrom

[57] ABSTRACT

At the start of a game, a player makes a wager. After three cards are dealt face down to the player and two cards are dealt face up to a dealer, the player chooses either to continue the risk of the wager, surrender and forfeit half of the wager, double the wager or triple the wager when the two face up cards are a pair. When the player does not choose to surrender, the player is dealt two additional cards. The player designates one of his cards as a Joker whereby the player has a Poker hand comprised of four cards and a Joker. The dealer is dealt three additional cards. The dealer designates one of his cards as a Joker whereby the dealer has a Poker hand comprised of four cards and a Joker. A payout is made to the player when the player's hand has a rank that is at least as high as the rank of the dealer's hand. The player may participate in a jackpot by contributing money to a jackpot pool prior to cards being dealt. A payout from the pool is based upon the rank of the player's hand.

9 Claims, 1 Drawing Sheet

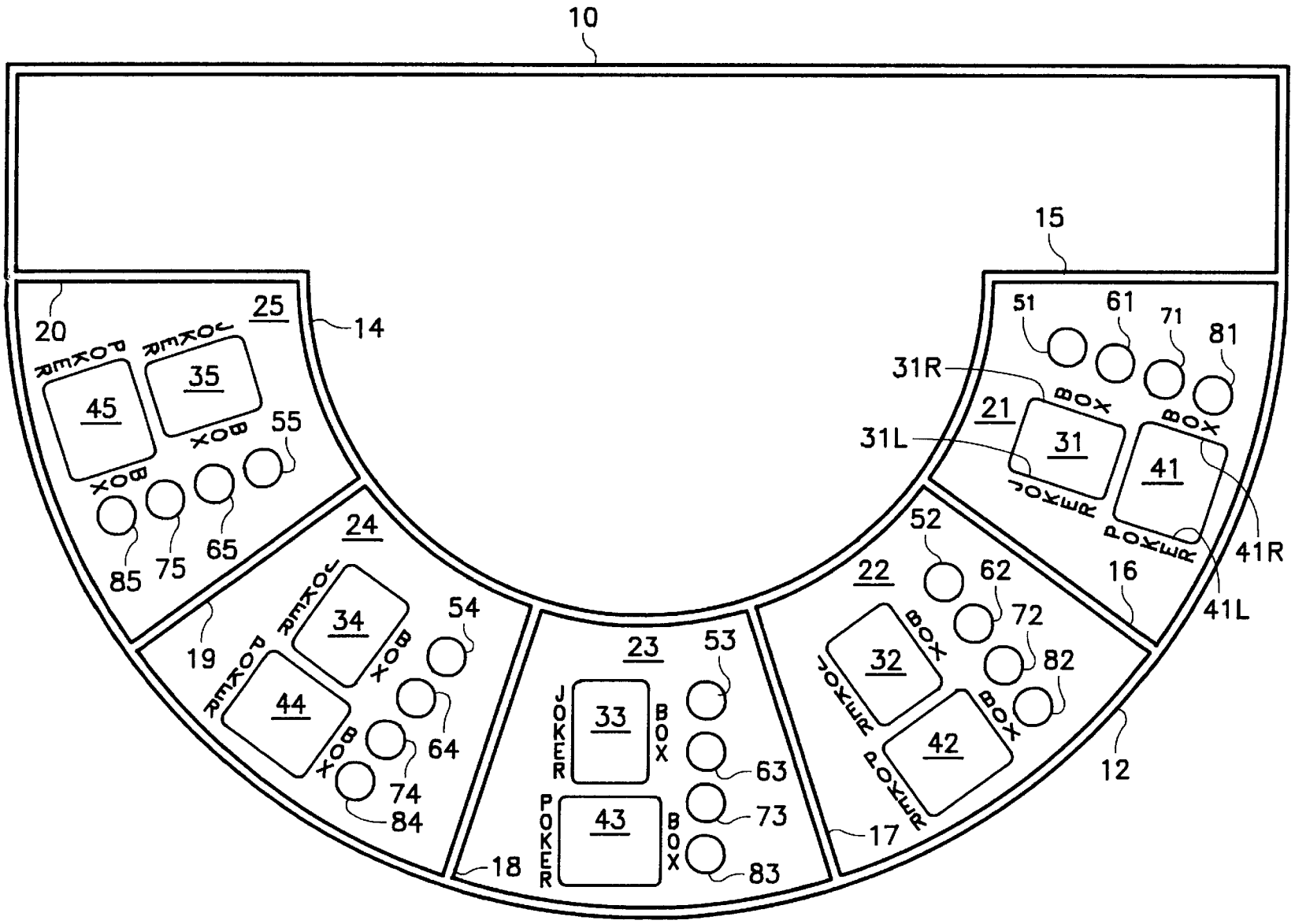
10
12
14
15
16
17
18
19
20
21
22
23
24
25
31
31R
31L
32
33
34
35
41
41R
41L
42
43
44
45
51
52
53
54
55
61
62
63
64
65
71
72
73
74
75
81
82
83
84
85
JOKER
POKER
BOX

POKER GAME WITH DESIGNATABLE JOKERS

BACKGROUND OF THE INVENTION

1. Field of Invention

This invention is in the general field of casino gaming and, more particularly, is a method of playing a Poker game in a casino.

2. Description of the Prior Art

Poker is the most frequently played card game in the United States. Moreover, Poker has a gambling aspect whereby a player is permitted to wager that he holds a poker hand that is superior to poker hands held by all other players in the game. Without the gambling aspect, Poker would be one of the least frequently played card games.

What is arguably the earliest form of poker was played with a deck of twenty cards during the 1830's on Mississippi river boats. Currently, there are approximately 100 variations of poker, most of which are played with a conventional deck of 52 cards. Typically, the number of players in a Poker game is from two to eight.

An invariant feature of almost all Poker games is that a hand is comprised of five cards. The value of the hand is determined by its rank. The player with the highest ranking hand is usually the winner. The rankings of Poker hands, in descending order, are given as:

ROYAL FLUSH, (Ace, King, Queen, Jack and 10 of the same suit);

STRAIGHT FLUSH, (five cards in sequence in any suit, i.e. Jack, 10, 9, 8, 7, of the same suit);

FOUR OF A KIND, (four Aces is highest);

FULL HOUSE, (THREE OF A KIND plus a PAIR, i. e., 10, 10, 10, King King);

FLUSH (Five cards of the same suit);

STRAIGHT (five cards in sequence but of different suits, i.e., (Jack, 10, 9, 8, 7);

THREE OF A KIND (Three cards of the same rank, i.e., three Aces);

TWO PAIRS (i.e., two Kings and two 10's);

ONE PAIR (two 5's); and

NO PAIR

In a notable variation, poker is sometimes played with a deck of cards that includes a Joker which carries an image of a medieval court jester. The Joker is what is known as a wild card which has any desired rank. When, for example, a hand includes an Ace, 10, 4, 3, Joker, the Joker can have the rank of an Ace whereby the hand has the rank of a pair of Aces.

Traditionally, in the Poker game, one player plays against all other players. However, because of an increased popularity of casino gaming, there has been a correspondingly increased popularity of Casino Poker games where each player plays against a dealer who represents the casino. Exemplary of the Casino Poker games is Caribbean Stud Poker which is described in U. S. Pat. No. 4,836,553.

In all but small stake traditional Poker games, the casino charges an hourly fee for providing a dealer and whatever else is needed. However, the Casino Poker game is structured to give the casino an advantage that can provide more revenue than the hourly fee.

SUMMARY OF THE INVENTION

According to a first aspect of the present invention, at the start of a game, a player makes a wager. After three cards are dealt to the player and two cards are dealt face up to a dealer, the player chooses either to continue the risk of the wager, surrender and forfeit half of the wager, double the wager or triple the wager when the two face up cards are a pair. When the player does not choose to surrender, the player is dealt two additional cards to provide the player with a total of five cards. The player designates one of the five player's cards as a Joker whereby the player has a Poker hand comprised of four cards and a Joker. The dealer is dealt three additional cards to provide the dealer with a total of five cards. The dealer designates one of the five dealer's cards as a Joker whereby the dealer has a Poker hand comprised of four cards and a Joker. A payout is made to the player when the player's hand has a rank that is at least as high as the rank of the dealer's hand.

According to a second aspect of the present invention, a new type of poker game utilizes a semi-circular top surface of a table for placement thereon of cheques and cards. The surface includes a plurality of similar wagering areas, each of which carries two rectangular indicia that have the approximate dimensions of a playing card. Additionally, each wagering area carries four similar circular indicia that have the approximate diameter of a cheque.

The invention is a Poker game where a player plays against a casino as represented by a dealer. The player and the dealer are each permitted to designate one of five cards of their respective Poker hands as a Joker, thereby making the game more exciting than other card games heretofore played in a casino.

Other objects, features, and advantages of the invention should be apparent from the following description of the preferred embodiment thereof as illustrated in the accompanying drawing.

BRIEF DESCRIPTION OF THE DRAWING

The sole FIGURE herein is a plan view of a surface used in playing a Poker game in accordance with the preferred embodiment of the present invention.

DESCRIPTION OF THE PREFERRED EMBODIMENT

In a new type of poker game, a player plays against a dealer who represents a casino. As shown in the drawing, in the preferred embodiment, the game utilizes a semi-circular top surface of a table for placement thereon of cheques representative of money and cards. The surface is typically made from green felt.

The surface has a straight edge 10 and an arcuate edge 12. The dealer (not shown) is usually positioned adjacent to the surface near the center of the edge 10.

The surface carries an arcuate line 14 that is parallel to the edge 12 and radial lines 15–20 that connect the edge 12 and the line 14. The edge 12 and the lines 14–20 are boundaries of enclosures of five wagering areas that each extend to the edge 12 and the line 14.

More particularly, the edge 12 and the lines 14–16 form an enclosure of a first wagering area 21. In a similar manner, the edge 12 and the lines 14, 16, 17 form an enclosure of a second wagering area 22; the edge 12 and the lines 14, 17, 18 form an enclosure of a third wagering area 23; the edge 12 and the lines 14, 18, 19 form an enclosure of a fourth wagering area 24; the edge 12 and the lines 14, 19, 20 form an enclosure of a fifth wagering area 25.

Preferably, a first player is positioned near the surface adjacent to the wagering area 21. In a similar manner, second, third, fourth and fifth players are preferably positioned adjacent to the wagering areas 22–25, respectively.

Because there are five wagering areas, no more than five players can play the game. However, in an alternative embodiment there may be more than the five wagering areas.

Within the wagering area 21, at its approximate center, the surface carries a generally rectangular indicium 31 that has long sides 31L, 31R. The indicium 31 has approximately the dimensions of a playing card and is oriented so that a construction line (not shown) that is parallel to the sides 31L, 31R and passes through the center of the indicium 31, perpendicularly intersects the line 14 and the edge 12.

The indicium 31 encloses an image of a Joker and lettering of the word, JOKER. Additionally, the surface carries lettering of the word, JOKER, and the word, BOX, adjacent to the sides 31L, 31R, respectively, unenclosed by the indicium 31. Moreover, the unenclosed lettering of the word, JOKER, and the word, BOX, is parallel to the sides 31L, 31R. Accordingly, the indicium 31 is identified as a Joker box.

Within the wagering areas 22–25, the surface carries indicia 32–35, respectively, that are similar to the Joker box indicium 31. The locations and orientations of the indicia 32–35 within the respective wagering areas 22–25 corresponds to the location and orientation of the Joker box indicium 31 within the wagering area 21. Because of the corresponding locations and orientations, the indicia 31–35 are in an arcuate alignment that is parallel to the line 14 and the edge 12.

Lettering of the word, JOKER, and the word, BOX, is carried on the surface adjacent to the indicia 32–35 in a manner similar to that described in connection with the indicium 31. Accordingly, the indicia 32–35 are each identified as a Joker box.

Within the wagering area 21, the surface additionally carries a generally rectangular indicium 41 in a space between the indicium 31 and the edge 12. The indicium 41 has the approximate dimensions of the indicia 31.

The indicium 41 is oriented so that short sides 41L, 41R of the indicium 41 are parallel to the sides 31L, 31R. Additionally, the construction line referred to hereinbefore passes through the center of the indicium 41.

The surface carries lettering of the word, POKER, and the word, BOX, adjacent to the sides 41L, 41R, respectively, unenclosed by the indicium 41. Moreover the unenclosed lettering of the word, POKER, and the word, BOX is parallel to the sides 41L, 41R. Accordingly, the indicium 41 is identified as a Poker box.

Within the wagering areas 22–25, the surface carries indicia 42–45, respectively, that are similar to the Poker box indicium 41. The locations and orientations of the indicia 42–45 within the respective wagering areas 22–25 corresponds to the location and orientation of the Poker box indicium 41 within the wagering area 21. Because of the corresponding locations and orientations, the indicia 41–45 are in an arcuate alignment that is parallel to the line 14 and the edge 12.

Lettering of the word, POKER, and the word, BOX, is carried on the surface adjacent to the indicia 42–45 in a manner similar to that described in connection with the indicium 41. Accordingly, the indicia 42–45 are each identified as a Poker box.

Within the wagering area 21, in a space between the indicia 31, 41 and the line 15, the surface carries similar circular indicia 51, 61, 71, 81 that have the approximate diameter of a cheque. The center of the indicium 51 has a displacement from the line 14 that is slightly larger than the displacement of the indicium 31 from the line 14. The center of the indicium 81 has a displacement from the edge 12 that is slightly larger than the displacement of the indicium 41 from the edge 12.

The centers of the indicia 51, 61, 71, 81 are equally spaced along a line that is parallel to the sides 31L, 31R with the indicium 61 disposed adjacent to the indicia 51, 71 and the indicium 71 disposed adjacent to the indicia 61, 81. Lettering of the word, SURRENDER, and the fraction, ½, the word, PLAY, the words, DOUBLE UP, and the words, TRIPLE UP, are carried within the indicia 51, 61, 71, 81, respectively.

Within the wagering areas 22–25, the surface carries:

(a) indicia 52–55, respectively, that are similar to the indicium 51;

(b) indicia 62–65, respectively, that are similar to the indicium 61;

(c) indicia 72–75, respectively, that are similar to the indicium 71; and (d) indicia 82–85, respectively, that are similar to the indicium 81.

The locations of the indicia 52–55, the indicia 62–65, the indicia 72–75 and the indicia 82–85 corresponds to the locations of the indicia 51, 61, 71, 81, respectively. Because of the corresponding locations, the indicia 51–55, the indicia 62–65, the indicia 72–75 and the indicia 82–85 are in arcuate alignments that are parallel to the line 14 and the edge 12. Additionally, lettering carried within the indicia 52–55, the indicia 62–65, the indicia 72–75 and the indicia 82–85 is similar to the lettering carried within the indicia 51, 61, 71, 81, respectively.

At the start of the game, the first player places cheques representative of a wager within the indicium 61. In a similar manner, the second, third, fourth and fifth players place cheques representative of wagers within the indicia 62–65, respectively.

After the cheques are placed, the dealer deals himself two cards face up and three cards face down to each of the players. Because the player's card are dealt face down, the players are denied knowledge of what each others cards are.

After the players examine the dealer's two face up cards and their three face down cards, the players must each choose either to continue the risk of their wager, surrender and forfeit half of their wager, double their wager or triple their wager when the two face up cards are a pair.

When the first player chooses to continue the risk of his wager, the choice is indicated by the first player permitting his cheques to remain within the indicium 61. In a similar manner, all other players indicate the choice of continuing their wager. A player who chooses to continue the risk is an active player.

When the first player chooses to surrender, the choice is indicated by the first player moving the cheques from the indicium 61 to within the indicium 51. The dealer removes the cheques from the indicium 51 and remits cheques representative of one half of the first player's wager.

Correspondingly, the second, third, fourth and fifth players indicate the choice of surrendering by moving the cheques from the indicia 62–65 to within the indicia 52–55, respectively. The removal of cheques and remissions by the dealer to the second, third, fourth and fifth players is similar to that described in connection with the first player. A player who chooses to surrender is an inactive player.

When the first player chooses to double his wager, the choice is indicated by the first player moving the cheques from the indicium 61 to within the indicium 71. Additionally, the first player augments the cheques within the indicium 71 to cause the cheques therein to represent the doubled wager.

Correspondingly, the second, third, fourth and fifth players indicate the choice of doubling their wagers by moving the cheques from the indicia 62–65 to within the indicia 72–75, respectively. The augmentation of the cheques by the second, third, fourth and fifth placers corresponds to that described in connection with the first player's doubling of his wager. A player who chooses to double his wager is an active player.

When the dealer's first two face up cards are a pair and the first player chooses to triple his wager, the choice is indicated by the first player moving the cheques from the indicium 61 to within the indicium 81. Additionally, the first player augments the cheques within the indicium 81 to cause the cheques therein to represent the tripled wager.

Correspondingly, the second, third, fourth and fifth players indicate the choice of tripling their wagers by moving the cheques from the indicia 62–65 to within the indicia 81–85, respectively. The augmentation of the cheques by the second, third, fourth and fifth placers corresponds to that described in connection with the first player's tripling of his wager. A player who chooses to triple his wager is an active player, After the choices by the players are made, the active players are each dealt two cards, preferably face down, whereby the active players each have five cards. The dealer is dealt three cards face up whereby the dealer has five cards.

When the first player, for example, is active, he designates one of his five cards as a joker which is placed, preferably face down, within the Joker Box indicium 31. It should be understood that the Joker is a wild card that is chosen to cause the first player to formulate the best possible Poker hand from his five cards. The four remaining cards of the first player are placed, preferably face down, within the Poker box indicium 41.

Correspondingly, each of the second, third, fourth or fifth players who are active, designate one card as a Joker and place it within the Joker Box indicia 32–35, respectively; their four remaining cards are placed within the Poker box indicia 42–45, respectively. Hence, each active player has a Poker hand comprised of their designated Joker within a Joker box and four cards within a Poker box. In a similar manner, one of the dealer's cards is designated as a Joker by the dealer.

When the first player is active, the dealer turns the cards within the Poker box indicia 41 face up, thereby exposing four cards of the first player's hand. As explained hereinafter, it is sometimes necessary for the first player to expose the card within the Joker box 31.

When the first player's hand has a rank of one pair, the first player loses his entire wager. In a similar manner, all other active players having a hand with the rank of one pair lose their entire wager.

When the first player's hand is qualified by having a rank higher than one pair, the first player's hand is compared to the dealer's hand. The first player wins his wager by having a hand with a rank that is at least as high as the rank of the dealer's hand. In a similar manner, all other active players win their wagers. A payout is made to a winning player in a manner described hereinafter.

When the dealer's hand has a rank that is higher than the rank of the first player's hand, the dealer wins the first player's entire wager. The dealer similarly wins the entire wager of any other active player.

Hands that are comprised of four cards and a Joker have a probability of occurrence different from what is encountered in traditional poker. Additionally, the inclusion of a joker causes a possibility of a hand not included in hands that are encountered in traditional Poker. Because of the inclusion of the Joker, the ranking of hands in the game, in descending order, is given as:

NATURAL ROYAL FLUSH (a five card royal flush without use of a Joker)

FIVE OF A KIND

WILD ROYAL FLUSH (a royal flush using the Joker)

STRAIGHT FLUSH

FOUR OF A KIND

FLUSH

FULL HOUSE

THREE OF A KIND

WORSE THAN THREE OF A KIND

When an active player has the natural royal flush, the active player is obliged to turn up his Joker. Additionally, when the active player uses the Joker for a flush, the Joker fills the highest opening in the active player's hand. When, for example, the active player's hand includes his joker and an Ace, King, 9 and 5, all of the same suit, the Joker becomes a Queen of that suit.

A payout made to the active player is in accordance with the rank of the active player's hand. More particularly, the payout to the active player preferably equals the active player's entire wager multiplied by a multiplier of a multiplier schedule which is given as:

| PLAYER'S HAND | MULTIPLIER |
|---|---|
| NATURAL ROYAL FLUSH | 50 |
| FIVE OF A KIND | 8 |
| WILD ROYAL FLUSH | 5 |
| STRAIGHT FLUSH | 2 |
| THREE OF A KIND OR BETTER | 1 |

Thus, for example, when the active player's wager is five dollars, his first three cards are King of spades, Queen of spades and Jack of spades and he chooses to double his wager, the active player's entire wager is ten dollars. If the active player's next two cards are an Ace of spades and a five of hearts, the active player's hand is a wild royal flush whereby the active player receives a payout of fifty dollars.

When the multiplier schedule is used compute the amount of a payout and a player uses an optimal strategy in playing the game, the casino has an advantage that has been computed to be 3.1008%. In other words, for a dollar wagered by the player who uses the optimal strategy, the casino, on average, retains 3.1008 cents.

Preferably, a player is permitted to participate in a jackpot. The player participates by contributing cheques representative of a predetermined amount of money to a jackpot pool prior to any cards being dealt. A payout from the jackpot pool is based upon the rank of the player's hand. When the predetermined amount is one dollar, a jackpot payout is preferably in accordance with a Jackpot schedule which is given as:

| HAND | JACKPOT PAYOUT(DOLLARS) |
|---|---|
| FULL HOUSE | 3 |
| FLUSH | 4 |

-continued

| HAND | JACKPOT PAYOUT(DOLLARS) |
|---|---|
| FOUR OF A KIND | 7 |
| STRAIGHT FLUSH | 25 |
| WILD ROYAL FLUSH | 200 |
| FIVE OF A KIND | 500 |
| NATURAL ROYAL FLUSH | 10,000 |

When the Jackpot schedule is used to determine the amount of a jackpot payout, the casino has an advantage that has been computed to be 14.4975%. In other words, for every dollar contributed to the jackpot pool, the casino retains, on average, 14.4975 cents.

While the invention has been particularly shown and described with reference to a preferred embodiment thereof, it should be understood by those skilled in the art that changes in form and detail may be made therein without departing from the spirit and scope of the invention.

I claim:

1. A method of playing a Poker game where a player plays against a dealer who represents a casino, comprising the steps of:

said player making a wager against said dealer at the start of the game;

dealing three cards to said player;

dealing two cards, face up, to said dealer;

giving said player a choice of either continuing the risk of said wager, surrendering and forfeiting half of said wager, doubling said wager or tripling said wager when the dealer's two face up cards are a pair;

dealing two additional cards to said player and three additional cards to said dealer when said player does not choose to surrender whereby said player and said dealer each have five cards;

said player designating of one of said player's five cards as a Joker, whereby said player has a Poker hand with four cards and a Joker;

said dealer designating one of said dealer's five cards as a Joker, whereby said dealer has a Poker hand with four cards and a Joker;

comparing said player's hand to said dealer's hand, said player winning said wager when the rank of said player's hand is at least as high as the rank of said dealer's hand; and making a payout to said player when said player wins said wager.

2. In the method of claim 1, wherein said step of dealing three cards to said player includes dealing said three cards face down when said player is one of a plurality of players in said game.

3. In the method of claim 1 wherein the ranking of hands, in descending order is given as:

NATURAL ROYAL FLUSH (a five card royal flush without use of a Joker)

FIVE OF A KIND

WILD ROYAL FLUSH (a royal flush using the Joker)

STRAIGHT FLUSH

FOUR OF A KIND

FLUSH

FULL HOUSE

THREE OF A KIND

WORSE THAN THREE OF A KIND.

4. In the method of claim 3 wherein said player's hand is qualified for said step of comparing when said player's hand has a rank higher than one pair, said player losing said wager when said player's hand has a rank of one pair.

5. In the method of claim 4 wherein said payout is in accordance with a schedule that gives said casino an approximately 3.1% advantage when said player uses an optimal strategy in playing said game.

6. In the method of claim 5 wherein said payout equals said wager multiplied by a multiplier of a multiplier schedule which is given as:

| PLAYER'S HAND | MULTIPLIER |
|---|---|
| NATURAL ROYAL FLUSH | 50 |
| FIVE OF A KIND | 8 |
| WILD ROYAL FLUSH | 5 |
| STRAIGHT FLUSH | 2 |
| THREE OF A KIND OR BETTER | 1. |

7. In the method of claim 4, the additional step of permitting said player to contribute a predetermined amount to a jackpot pool prior to any cards being dealt, a payout from said pool being based upon the rank of said player's hand.

8. In the method of claim 7 wherein said payout from said pool is in accordance with a schedule that gives said casino an approximately 14.5% advantage.

9. In the method of claim 8, when said predetermined amount is one dollar, a jackpot payout is in accordance with a Jackpot schedule which is given as:

| HAND | JACKPOT PAYOUT(DOLLARS) |
|---|---|
| FULL HOUSE | 3 |
| FLUSH | 4 |
| FOUR OF A KIND | 7 |
| STRAIGHT FLUSH | 25 |
| WILD ROYAL FLUSH | 200 |
| FIVE OF A KIND | 500 |
| NATURAL ROYAL FLUSH | 10,000. |

* * * * *